United States Patent [19]

Hyun et al.

[11] Patent Number: 4,795,196

[45] Date of Patent: Jan. 3, 1989

[54] METHOD FOR ORGANIZING MERCHANDISING COUPONS AND COUPON STORAGE DEVICE

[75] Inventors: David K. Hyun, Pasadena; Clifford A. Higgins, II, Altadena; William H. Morgan, Pasadena, all of Calif.

[73] Assignee: Value Savers Unlimited, Pasadena, Calif.

[21] Appl. No.: 79,674

[22] Filed: Jul. 30, 1987

[51] Int. Cl.[4] ..... B42D 15/00; B42F 21/00; B42F 17/00

[52] U.S. Cl. ..... 283/67; 40/360; 211/50; 283/56; 283/36

[58] Field of Search ..... 40/359, 360, 371, 372; 211/11, 50, 59.4; 283/1 R, 56, 67, 36, 37, 38

[56] References Cited

U.S. PATENT DOCUMENTS

| | | | |
|---|---|---|---|
| D. 291,386 | 8/1988 | Johansson | D3/35 |
| 1,153,767 | 9/1915 | Carrill | 40/360 X |
| 1,635,310 | 7/1927 | Burdic | 40/359 |
| 2,374,695 | 5/1945 | Murray | 40/359 |
| 2,616,612 | 11/1952 | Guttman | 283/56 X |
| 4,572,547 | 2/1986 | Phillips | 283/36 |
| 4,636,179 | 1/1987 | Gentile et al. | 283/56 X |
| 4,641,897 | 2/1987 | Long et al. | 211/50 X |
| 4,725,077 | 2/1988 | Fujita | 253/67 |

*Primary Examiner*—Paul A. Bell

*Attorney, Agent, or Firm*—Christie, Parker & Hale

[57] ABSTRACT

A consumer product coupon storage device comprises a coupon storage bin and a plurality of dividers adapted to fit in the bin to separate the space in the bin into individual compartments. Each divider has first and second visible fields. A generic product descriptor is printed in the first field of each divider. A brand-name product advertisement is printed in the second field of each divider. The brand-name product belongs to the class of the generic product, the descriptor which is printed on the same divider as, or a divider near, the advertisement of said brand-name product. In use, the coupons are placed in the compartments sorted by generic product.

6 Claims, 4 Drawing Sheets

METHOD FOR ORGANIZING MERCHANDISING COUPONS AND COUPON STORAGE DEVICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

This invention relates to merchandising and advertising vehicles and, more particularly, to a method and device for organizing and storing merchandizing coupons in a manner that presents the opportunity to advertise name-brand products and retail businesses.

A formidable segment of the purchasing public collects merchandising coupons and redeems these coupons at retail establishments, such as food markets, convenience stores, etc. to obtain a discount on consumer-product purchases. It is comical to observe the manner in which many coupon collectors organize and store their coupons to gain ready access to the desired coupon when a purchase is made. This process often requires the expenditure of substantial time, effort and patience.

Indicative of the popularity of collecting coupons and the purchasing power of those who do so is the enormous amount of monies spent by brand-name manufacturers on advertisements offering coupons to the public. Further evidence of the purchasing power of coupon collectors is the practice of many retailers to offer double discounts for coupons redeemed at their business establishment. Thus, coupon collectors represent a fertile target audience for brand-name advertising messages.

SUMMARY OF THE INVENTION

One aspect of the invention is a consumer product coupon storage device that presents the opportunity for advertisers to deliver to the user a message about brand-name products. The device comprises a coupon storage bin and a plurality of dividers adapted to fit in the bin to separate the space in the bin into individual compartments. Each divider has first and second visible fields. A generic product descriptor is printed in the first field of each divider. A brand-name product advertisement is printed in the second field of each divider. The brand-name product belongs to the class of the generic product, the descriptor which is printed on the same divider as, or a divider near, the advertisement of said brand-name product. The device functions as a home billboard, if you will, to powerful, promotional tool, in that the user of the device has before him or her a continuous stream of advertisements as he or she adjusts the dividers to store coupons in and retrieve coupons from the individual compartments of the bin.

A feature of the invention is a consumer-product coupon storage device, as described above, that also presents the opportunity to advertise a retail business. Specifically, the coupon storage bin, described above, has at least one field on its outer surface on which an advertisement for a retail business is printed. The retail business might be a food market or other store where consumer and/or food products are sold.

Another aspect of the invention is a method of organizing merchandising or consumer-product coupons. This method comprises printing on an area of a plurality of file dividers different generic product descriptors, printing on another area of the dividers different brand-name product advertisements, inserting the dividers in a container to form separate compartments corresponding to the different generic products, and placing the coupons in the compartments sorted by generic product. The brand-name product advertised on each divider belongs to the class of the generic product, the descriptor of which is printed on the same divider as the advertisement of said brand-name product. As the user places coupons in the compartments and removes coupons from the compartments, the advertisements on the dividers are revealed to the user, and the advertising message is delivered to the user.

BRIEF DESCRIPTION OF THE DRAWINGS

The features of a specific embodiment of the best mode contemplated of carrying out the invention are illustrated in the drawings, in which.

DETAILED DESCRIPTION OF THE SPECIFIC EMBODIMENT

Figure 1:
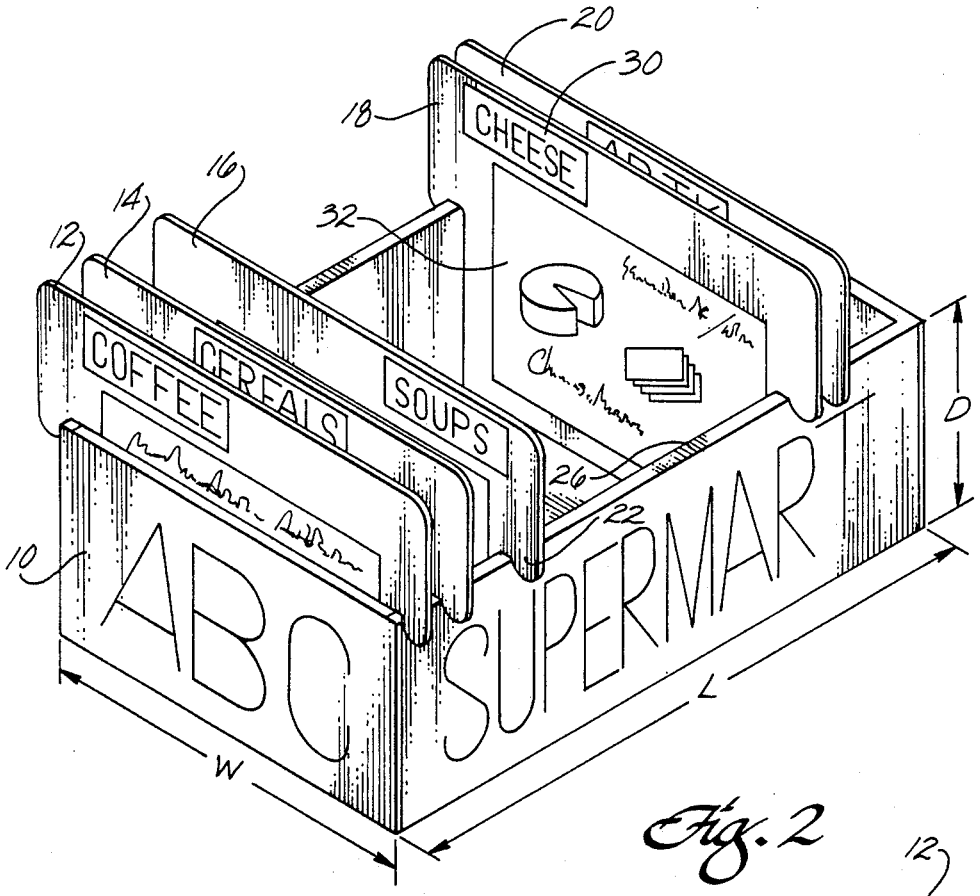
FIG. 1 is a perspective view of a coupon storage device incorporating principles of the invention.

In FIG. 1 a consumer-product coupon storage device comprises a coupon storage bin 10 and a plurality of file divider cards 12 to 20. The number of file divider cards is a matter of choice. Bin 10 serves as a container for merchandising coupons, i.e., coupons that are redeemable at retail establishments for discounts on consumer-product purchases. Bin 10 is rectangular in shape, having four sides, a bottom and an open top. As a result, bin 10 forms a regular hexahedral interior storage space having a length L, a width W, and a depth D. Divider cards 12 to 20 are adapted to fit into the space in bin 10 parallel to the width and depth dimension and perpendicular to the length dimension, thereby separating the space in bin 10 into individual compartments. The top corners of cards 12 to 20 each have downwardly extending hooks 22 and 23 that, with the remainder of the side edges of the card, form notches 24 and 25, respectively. The top of bin 10 has side edges 26 and 28, which serve as rails to guide and support divider cards 12 to 20 as they move parallel to the length of bin 10 and thereby adjust the size of the individual compartments. Specifically, side edges 26 and 28 fit in notches 24 and 25, respectively, and hooks 22 and 23 adjoin the long sides of bin 10.

As illustrated in FIG. 1, one side of each of divider cards 12 to 20, preferably the front side, has a visible field or area 30 adjoining the top edge of the divider card, and a field or area 32 that covers most of the remainder of the surface of the divider card. A different generic product descriptor is printed in field 30 of each divider card. The location of field 30 is not critical. By way of example, it could be centered at the top, cards 12–20, placed on the left side thereof, placed on the right side thereof, or staggered left—center—right. A brand-name product advertisement is printed in field 32 of each divider card. The brand-name product belongs to the class of the generic product, the descriptor of which is printed on the same divider card as the advertisement of said brand-name product. For example, if the generic product descriptor on the card is "Soft Drinks", the advertisement printed on the same card might be for COCA COLA, PEPSI COLA, DR. PEPPER or 7-UP, which belong to the generic class of Soft Drinks. If desired, the advertisement could be printed in the field 32 of a divider card adjacent to or near the divider card on which the corresponding generic descriptor is printed.

Figure 2:
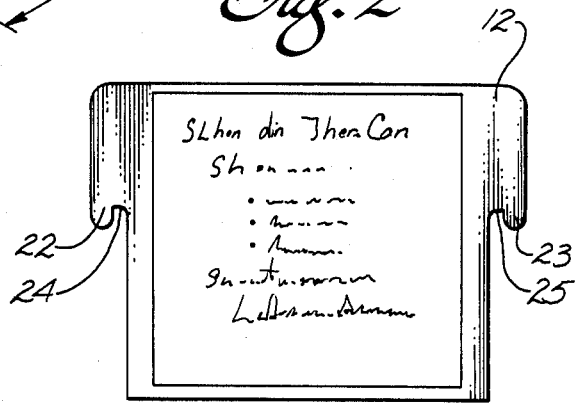
FIG. 2 is a back elevation view of one of the divider cards of the device of FIG. 1.

As illustrated in FIG. 2, the back side of each of divider cards 12 to 20 has a field 34 covering most of its surface. A brand-name product advertisement is also printed in field 34. The brand-name product could belong to the class of the generic product, the descriptor of which is printed on the same divider card as the advertisement of said brand-name product, or to the class of the generic product, the descriptor of which is printed on the next adjacent, or a nearby, divider card.

The following is a list of generic product descriptors used in a preferred embodiment of the invention:

1. Baby Food & Products
2. Cake Mixes
3. Candy
4. Canned Fruits
5. Canned Meat
6. Canned Vegetables
7. Cereals
8. Cheese
9. Coffee
10. Condiments
11. Cookies & Crackers
12. Cosmetics & Drugs
13. Dairy Products
14. Frozen Desserts
15. Frozen Dinners
16. Frozen Juices
17. Frozen Vegetables
18. Fruit Juice
19. Household Products
20. Jams & Jellies
21. Laundry Aids
22. Luncheon Meats
23. Miscellaneous
24. Paper Goods
25. Peanut Butter
26. Personal Care Products
27. Pet Foods
28. Salad Dressings
29. Seasonings
30. Snack Bars/Foods
31. Soft Drinks
32. Soups Value Savers Unlimited, 1987.

As further illustrated in FIG. 1, the outer surface of bin 10 has fields 35, preferably one field on each side and one field on the bottom, in which an advertisement for a retail business such as a market, convenience store, department or specialty store is printed. Preferably, the identical advertisement is printed in field 35 on each side so as to maximize the impact and consumer recognition.

In using the described coupon storage device, after the generic product descriptors and name-brand product advertisements are printed on divider cards 12 to 20, the divider cards are inserted in bin 10 with side edges 26 and 27 fitting in notches 24 and 25 to form separate compartments for storage of merchandising coupons. By way of example, the storage compartment for each generic product is located behind the divider card on which the descriptor of such generic product is printed. Then, the user places the coupons in the compartments sorted by generic product. In other words, all coupons for soft drinks are placed in the compartment behind the divider card on which the descriptor "Soft Drinks" is printed. In this way, the user, i.e., coupon collector, can quickly store his or her coupons in bin 10 and readily gain access to the desired coupons at the time of redemption. Through use of the storage device, the user is presented with the advertisements on the divider cards which give the brand-name product manufacturers the opportunity to deliver their advertising message to the user in the context of the generic product by virtue of the proximity of the advertisement to the compartment in which the related coupons are stored. The advertisement functions to communicate brand-name product information, and a message from a retail business to the coupon collector.

The opportunity for brand-name manufacturers to deliver their advertising messages to coupon collectors via the divider cards, can be a lucrative source of revenue to the publisher of the described coupon storage device. The opportunity for a retail business to present its advertising message on the outer surface of bin 10 can act as a strong incentive to retail businesses to distribute the device to the public, or more specifically to coupon collectors. In this way, the advertising messages of both sponsors, brand-name product manufacturers, and retail businesses is effectively delivered to the consuming public, or at least a segment thereof that collects coupons.

Figure 3:
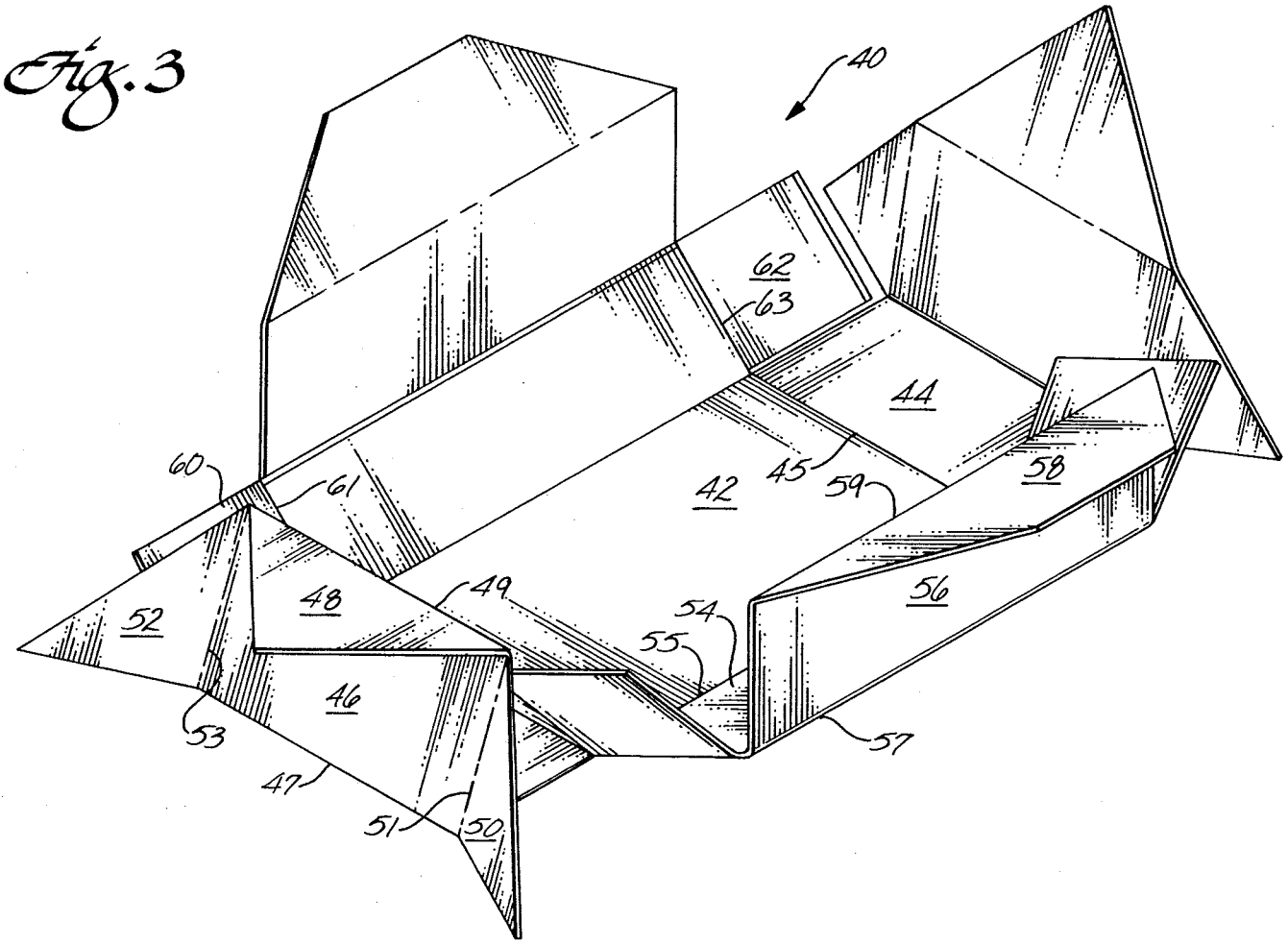
FIG. 3 is a perspective view of the coupon storage bin of the device of FIG. 1 in a disassembled state.
Figure 4:
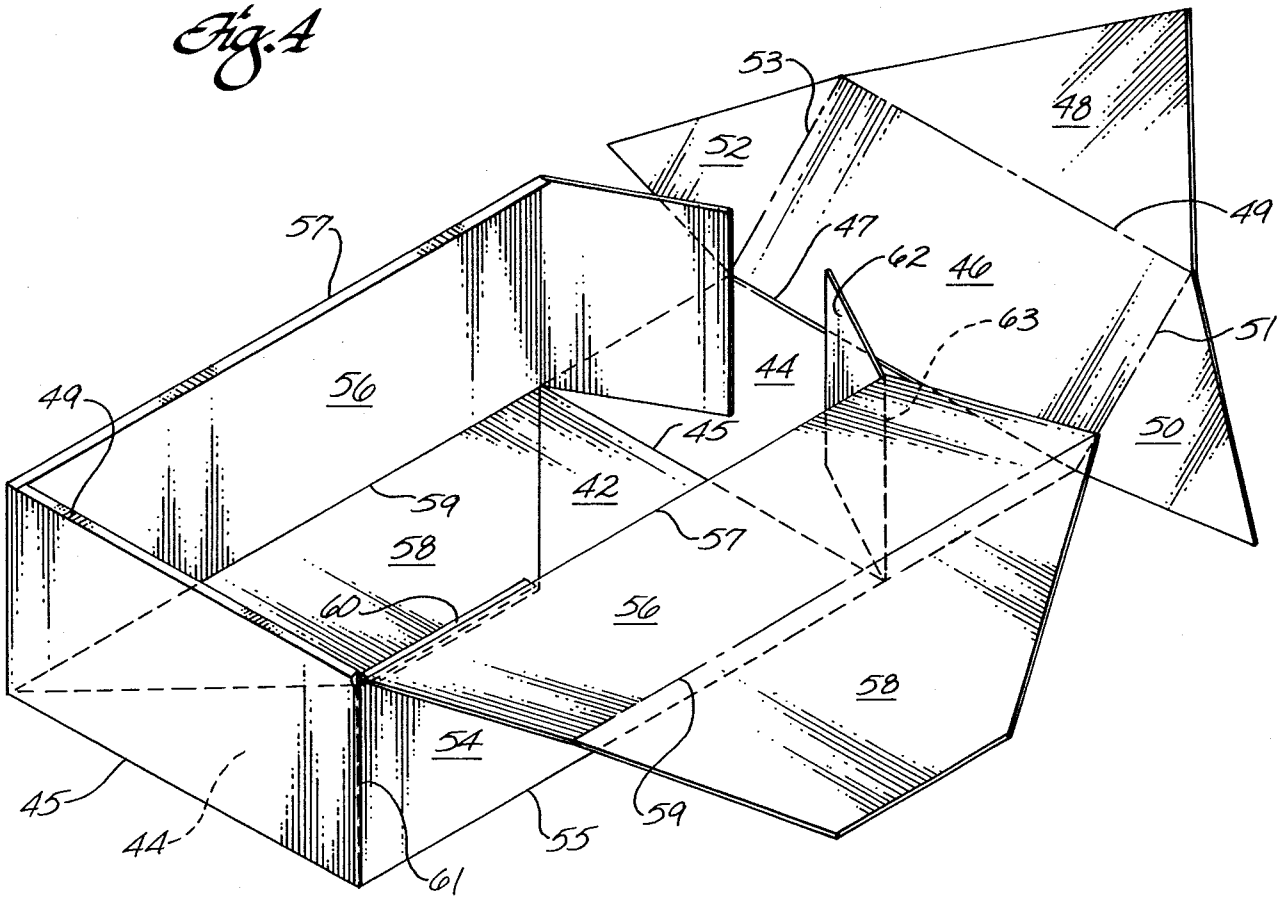
FIG. 4 is a perspective view of the coupon storage bin in a partially assembled state.
Figure 5:
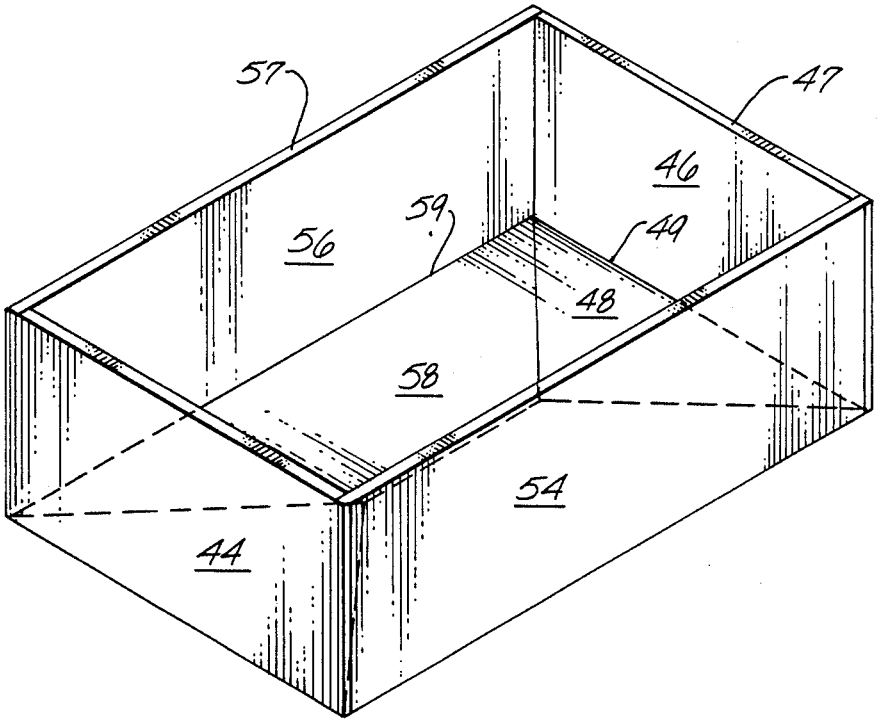
FIG. 5 is a perspective view of the coupon storage bin in an assembled state.

Reference is made to FIGS. 3 to 5 for a description of the construction of bin 10, which is made from a blank 40. Blank 40 is a single piece of cardboard folded into sections with the exception of a rectangular bottom section 42; the construction of blank 40 is symmetrical about its longitudinal and transverse axes and, therefore, each section labeled and described below has a counterpart on the other side of one of the axes of symmetry. A rectangular end outside section 44 is connected to the end of bottom section 42. A fold 45 is formed between sections 42 and 44. A rectangular end liner section 46 is connected to section 44. A fold 47 is formed between sections 44 and 46. A triangular end floor section 48 is connected to section 46. A perforated fold 49 is formed between sections 46 and 48. A triangular section 50 is connected to one edge of section 46, and a triangular section 52 is connected to the other edge of section 46. Perforated folds 51 and 53 are formed between sections 50 and 52, respectively, and section 46.

A rectangular side outside section 54 is connected to the side of bottom section 42. A fold 55 is formed between sections 54 and 42. A rectangular side liner section 56 is connected to section 55. A fold 57 is formed between sections 56 and 54. A trapezoidal side floor section 58 is connected to section 56. A perforated fold 59 is formed between sections 58 and 56. A rectangular section 60 is connected to one side edge of section 54, and a rectangular section 62 is connected to the other side edge of section 54. Perforated folds 61 and 63 are formed between sections 60 and 62, respectively, and section 54.

To assemble the bin from blank 40, sections 54 are first pivoted about folds 55 into a perpendicular position with respect to bottom section 42, while sections 46 are pivoted about fold 47 out of the way of sections 60 and 62, to permit sections 60 and 62 to lie perpendicular to sections 54 and 42. With sections 60 and 62 in this mutually perpendicular position, sections 44 are next pivoted about folds 45 into a position perpendicular to bottom sections 42, and sections 46 is pivoted about folds 47 into abutment with the surface of sections 44, thereby capturing between sections 44 and 46 sections 60 and 62. Sections 48 are then pivoted about folds 49 to lie perpendicular to sections 46 and in abutment with the surface of bottom sections 42. Finally, sections 56 is pivoted about folds 57 into abutment with sections 54, thereby capturing between sections 54 and 56 sections 50 and 52. To complete the construction and lock the sections in an assembled state, sections 58 are pivoted about folds 59 to lie perpendicular to sections 56 and in abutment with the surface of bottom section 42. As depicted in FIG. 5, floor sections 48 and 58 are so sized and shaped that they precisely fit within the interior of the bin in edge-abutting relationship. Thus, the edges of these sections hold all the sections of the folded blank 40 together in the described positions.

The described embodiment of the invention is only considered to be preferred and illustrative of the inventive concept; the scope of the invention is not to be restricted to such embodiments. Various and numerous other arrangements may be devised by one skilled in the art without departing from the spirit and scope of this invention. Although the invention is described in the context of organizing and storing merchandising coupons, it could be utilized to organize and store other flat generic articles in connection with which advertising messages associated with such articles are to be presented.

What is claimed is:

1. A method of organizing merchandising coupons comprising the steps of:

printing on an area of a plurality of file dividers different generic product descriptors;

printing on another area of the dividers different brand-name product advertisements, the brand-name product belonging to the class of the generic product, the descriptor of which is printed on the same divider as the advertisement of said brand-name product;

inserting the dividers in a container to form separate compartments corresponding to the different generic products; and placing the coupons in the compartments sorted by generic product.

2. A consumer-product coupon storage device comprising:

a coupon storage bin having an open top with side edges and a cubical interior space;

a plurality of dividers adapted to fit in the bin to separate the space in the bin into individual compartments, each divider having first and second visible fields and top corners with notches into which the side edges of the bin fit;

a generic product descriptor printed in the first field of each divider; and a brand-name product advertisement printed in the second field of each divider, the brand-name product belonging to the class of the generic product, the descriptor of which is printed on a divider near the advertisement of said brand-name product.

3. The storage device of claim 2 in which each descriptor is printed on the same divider as the advertisement of said brand-name product.

4. The storage device of claim 2 in which the bin has at least one visible field on its outer surface and a retail business advertisement is printed in said field.

5. The storage device of claim 1 in which the bin has four side faces and one bottom face and a retail business advertisement is printed on each face.

6. The storage device of claim 5 in which the same retail business advertisement is printed on each face of the bin.

* * * * *